US006080246A

United States Patent [19]

Wing

[11] Patent Number: 6,080,246

[45] Date of Patent: Jun. 27, 2000

[54] METHOD OF ALUMINISING A SUPERALLOY

[75] Inventor: Rodney G. Wing, Nottingham, United Kingdom

[73] Assignee: Rolls-Royce, PLC, London, United Kingdom

[21] Appl. No.: 08/892,588

[22] Filed: Jul. 14, 1997

[30] Foreign Application Priority Data

| | | | |
|---|---|---|---|
| Jul. 23, 1996 | [GB] | United Kingdom | 9615474 |
| Dec. 18, 1996 | [GB] | United Kingdom | 9626191 |

[51] Int. Cl.[7] ..... C23C 10/16; C23C 10/50

[52] U.S. Cl. ..... 148/512; 148/518; 148/527; 148/535

[58] Field of Search ..... 148/512, 514, 148/518, 527, 535

[56] References Cited

U.S. PATENT DOCUMENTS

| | | | |
|---|---|---|---|
| 4,101,714 | 7/1978 | Rairden, III | 428/639 |
| 4,310,574 | 1/1982 | Deadmore et al. | 427/405 |
| 4,374,183 | 2/1983 | Deadmore et al. | 428/641 |
| 4,526,814 | 7/1985 | Shankar et al. | 427/252 |
| 4,528,215 | 7/1985 | Baldi et al. | 427/252 |
| 4,820,362 | 4/1989 | Baldi | 149/2 |
| 5,057,196 | 10/1991 | Creech et al. | 428/652 |
| 5,077,141 | 12/1991 | Naik et al. | 428/680 |
| 5,139,824 | 8/1992 | Liburdi et al. | 427/252 |
| 5,334,263 | 8/1994 | Schaeffer | 148/217 |
| 5,498,484 | 3/1996 | Duberstadt | 148/514 |
| 5,547,770 | 8/1996 | Meelu et al. | 428/678 |
| 5,645,893 | 7/1997 | Rickerby et al. | 148/512 |

FOREIGN PATENT DOCUMENTS

| | | |
|---|---|---|
| 0 194 391 | 9/1986 | European Pat. Off. . |
| 545661 | 6/1993 | European Pat. Off. . |
| 567755 | 11/1993 | European Pat. Off. . |
| 0 587 341 | 3/1994 | European Pat. Off. . |
| 587341 | 3/1994 | European Pat. Off. . |
| 654542 | 5/1995 | European Pat. Off. . |
| 733723 | 9/1996 | European Pat. Off. . |
| 784104 | 7/1997 | European Pat. Off. . |
| 2-638174 | 4/1990 | France . |
| 1 456 656 | 11/1976 | United Kingdom . |
| 1 463 447 | 2/1977 | United Kingdom . |
| 1 545 305 | 5/1979 | United Kingdom . |
| 2 009 251 | 6/1979 | United Kingdom . |
| 2 130 249 | 5/1984 | United Kingdom . |
| WO 95/23243 | 8/1995 | WIPO . |

OTHER PUBLICATIONS

The Minerals, Metals & Materials Society, W.C. Walston et al., "A New Type Of Microstructural Instability In Superalloys—SRZ", pp. 9–18, Sep., 1996.

*Primary Examiner*—George Wyszomierski
*Attorney, Agent, or Firm*—Oliff & Berridge, PLC

[57] ABSTRACT

A high rhenium containing single crystal superalloy (30) is chromized, or coated with cobalt, before the conventional aluminising process steps to modify the surface of the high rhenium containing single crystal superalloy to prevent the formation of topologically close packed phases at the interface between the aluminide coating (32) and the rhenium containing single crystal superalloy. The invention is particularly applicable to platinum aluminide coatings, platinum aluminide-silicide coatings and aluminide-silicide coatings.

24 Claims, 3 Drawing Sheets

METHOD OF ALUMINISING A SUPERALLOY

The present invention relates to the application of aluminide coatings to superalloys, in particular single crystal superalloys.

Single crystal superalloys have been developed for gas turbine engine turbine blades and turbine vanes to provide optimum high temperature strength for the turbine blades and turbine vanes. However, the changes in the composition of the single crystal superalloys compared to the composition of earlier superalloys has resulted in these single crystal superalloys experiencing increased surface degradation. In addition there is a requirement for the turbine blades and turbine vanes to have longer service lives. Thus these single crystal superalloy turbine blades and turbine vanes are not providing satisfactory service lives due to their degradation by corrosion and oxidation.

These single crystal superalloys generally comprise rhenium, for example 2 to 8 wt % together with relatively high levels of tungsten and tantalum to obtain the high temperature strength characteristics. These single crystal superalloys are very strong at high temperatures due to the benefits of the rhenium, tungsten and tantalum.

In order to increase the service lives of single crystal turbine blades and turbine vanes it is desirable to protect the surface of the single crystal turbine blades or turbine vanes with a protective coating. One known type of protective coating which is commonly applied to turbine blades and turbine vanes is a platinum aluminide coating. The platinum aluminide coatings are applied by firstly coating the turbine blades, or turbine vanes, with platinum and by secondly aluminising the platinum coated turbine blades, or turbine vanes, using an aluminising processes. The aluminising process may be by pack aluminising process, by the out of pack gas phase aluminising process, by chemical vapour deposition or by other processes well known to those skilled in the art.

However, it has been found that if high rhenium containing single crystal superalloy turbine blades, or turbine vanes, are platinum aluminised using conventional processes topologically close packed phases are formed at the interface between the coating and the single crystal superalloy. High rhenium containing single crystal superalloys are those containing more than 4 wt % rhenium. These topologically close packed phases are formed directly following aluminising or following exposure to high temperatures. The topologically close packed phases contain high levels of rhenium, tungsten and chromium compared to the single crystal superalloy, and are more easily formed with increasing levels of rhenium in the single crystal superalloy. The topologically close packed phases increase in amount with increasing time at high temperatures. The topologically close packed phases adversely effect the mechanical properties of the single crystal superalloy. Thus it is not possible to use a conventional platinum aluminide coating to increase the resistance to degradation of a high rhenium containing single crystal superalloy without decreasing the mechanical properties of the single crystal superalloy.

Other types of protective coatings which are commonly applied to turbine blades and turbine vanes are aluminide-silicide coatings, platinum aluminide-silicide coatings, simple aluminide coatings and any other suitable aluminide coatings.

The aluminide coatings are applied using an aluminising process, by the out of pack gas phase aluminising process, by the pack aluminising process, by chemical vapour deposition or other processes well known to those skilled in the art.

One method of producing aluminide-silicide coatings is by depositing a silicon filled organic slurry on a superalloy surface and then pack aluminising as described in U.S. Pat. No. 4,310,574. The aluminium carries the silicon from the slurry with it as it diffuses into the superalloy. Another method of producing aluminide-silicide coatings is by depositing a slurry containing elemental aluminium and silicon metal powders to a superalloy surface and then heating to above 760 degrees C. to melt the aluminium and silicon in the slurry, such that they react with the superalloy and diffuse into the superalloy. A further method of producing aluminide-silicide coatings is by repeatedly applying the aluminium and silicon containing slurry and heat treating as described in U.S. Pat. No. 5,547,770. Another method of producing aluminide-silicide coatings is by applying a slurry of an eutectic aluminium-silicon or a slurry of elemental aluminium and silicon metal powders to a superalloy surface and diffusion heat treating to form a surface layer of increased thickness and reduced silicon content, and a layering layer which comprises alternate continuous interleaved layers of aluminide and silicide phases and a diffusion interface layer on the superalloy as described in published European patent application No. 0619856A.

One method of producing the platinum aluminide-silicide coatings is by coating the superalloy of the turbine blades, or turbine vanes, with platinum, then heating to diffuse the platinum into the turbine blade and then simultaneously diffusing aluminium and silicon from the molten state into the platinum enriched turbine blade as described in published International patent application No. W095/23243A. Another method of producing platinum aluminide-silicide coatings is by coating the superalloy turbine blades with platinum, then heat treating to diffuse the platinum into the turbine blade, a silicon layer is applied and is then aluminised as described in published European patent application No. EP0654542A. It is also possible to diffuse the silicon into the turbine blade with the platinum as described in EP0654542A. A further method of producing platinum aluminide silicide coatings is by electrophoretically depositing platinum-silicon powder onto the turbine blades, heat treating to diffuse platinum and silicon into the turbine blades, electrophoretically depositing aluminium and chromium powder and then heat treating to diffuse the aluminium and chromium into the turbine blades as described in U.S. Pat. No. 5,057,196.

It has been found that if high rhenium containing single crystal superalloy turbine blades, or turbine vanes, are coated with platinum aluminide-silicide coatings using the method described in W095/23243A that topologically close packed phases are formed at the interface between the coating and the single crystal superalloy. It is believed that if high rhenium containing single crystal superalloy turbine blades, or turbine vanes, are coated with platinum aluminide-silicide coatings by the other methods described that topologically close packed phases will be formed.

It has also been found that if high rhenium containing single crystal superalloy turbine blades, or turbine vanes, are coated with aluminide-silicide coatings using the method described in U.S. Pat. No. 5,547,770 that topologically close packed phases are formed at the interface between the coating and the single crystal superalloy. It is believed that if high rhenium containing single crystal superalloy turbine blades, or turbine vanes, are coated with aluminide-silicide coatings by any of the other suitable methods described that topologically close packed phases will be formed.

We believe that it is the high rhenium content of the single crystal superalloy which is responsible for forming the topologically close packed phases and that these phases will be formed during simple aluminising.

Thus additionally it is not possible to use platinum aluminide-silicide coatings, aluminide-silicide coatings or simple aluminide coatings to increase the resistance to degradation of a high rhenium containing single crystal superalloy without decreasing the mechanical properties of the single crystal superalloy.

The present invention seeks to provide a method of aluminising a high rhenium containing single crystal superalloy which overcomes the above mentioned problem.

Accordingly the present invention provides a method of aluminising a high rhenium containing superalloy comprising the steps of:

(a) modifying the surface of the high rhenium containing superalloy by applying a layer of a suitable metal to the surface of the high rhenium containing superalloy and heat treating to diffuse the suitable metal into the high rhenium containing superalloy to reduce the rhenium content of the surface of the high rhenium containing superalloy, and (b) aluminising the high rhenium containing superalloy to form an aluminide coating.

The suitable metal may be any metal which modifies the diffusion characteristics to reduce the formation of the regions of high rhenium content. Suitable metals are any metals compatible with the superalloy, for example cobalt, chromium and similar metals.

Step (a) may comprise applying the suitable metal to the high rhenium containing superalloy by electroplating, sputtering, pack diffusion, out of pack diffusion, chemical vapour deposition or physical vapour deposition.

The invention is particularly applicable to platinum aluminide coatings, platinum aluminide-silicide coatings and aluminide-silicide coatings, but is generally applicable to aluminide coatings on high rhenium containing superalloys.

BRIEF DESCRIPTION OF THE DRAWINGS

The present invention will be more fully described by way of examples with reference to the accompanying drawings, in which.

DETAILED DESCRIPTION OF THE INVENTION

In conventional, prior art, platinum aluminising process for a single crystal superalloy the single crystal superalloy is electroplated with a layer of platinum, and the platinum plated single crystal superalloy is heat treated in a vacuum to diffuse the platinum into the single crystal superalloy. The heat treated, platinum plated single crystal superalloy is aluminised using pack aluminising, out of contact gas phase aluminising, chemical vapour deposition or other suitable process. The aluminised, diffused, platinum plated single crystal superalloy is then heat treated in a protective atmosphere to optimise the platinum aluminide coating microstructure and composition and to maximise the mechanical properties of the single crystal superalloy.

Figure 1:
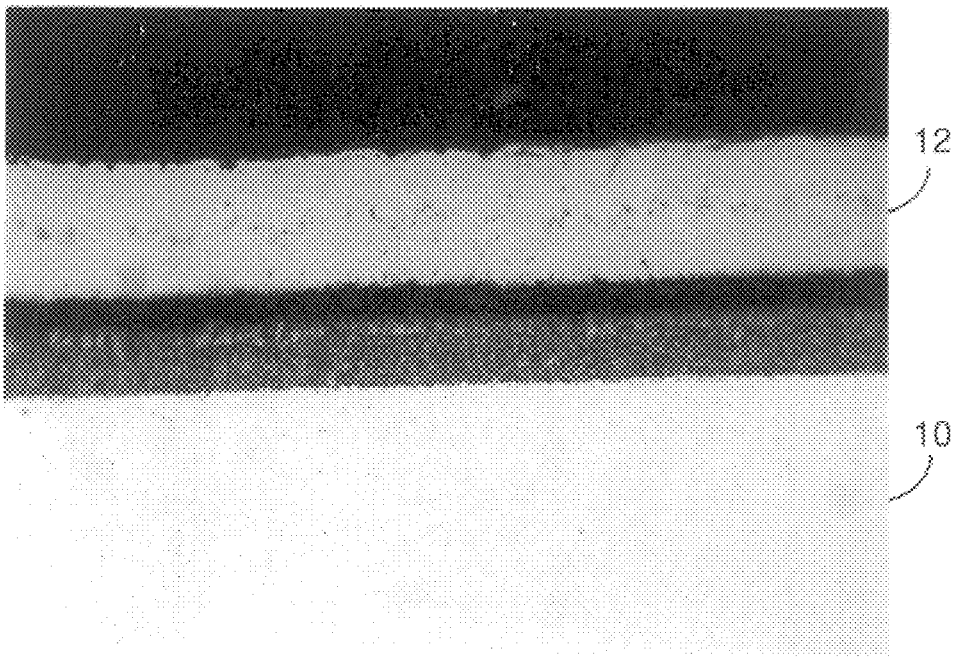
FIG. 1 is a cross-sectional view through a prior art platinum aluminide coating on a low rhenium containing single crystal superalloy.

During the heat treatment to diffuse the platinum into the single crystal superalloy, after deposition of the platinum layer on the single crystal superalloy, diffusion occurs between the platinum and the single crystal superalloy to form a surface layer containing platinum, nickel and other superalloy elements. The heat treatment diffusion step is of sufficient time and temperature to ensure that a suitable composition is attained in the diffused platinum layer so that the required platinum aluminide coating is obtained following the aluminising and heat treatment process steps. A conventional platinum aluminide coating 12 on a single crystal superalloy substrate 10 is shown in FIG. 1.

However, when a high rhenium containing single crystal superalloy is heat treated after deposition of the platinum layer, the inward diffusing platinum produces a zone enriched in rhenium and other refractory elements, for example tungsten and chromium, in front of it. In the subsequent aluminising and heat treatment process steps, to produce the required platinum aluminide coating, the zone enriched in rhenium and other refractory elements is retained within the coating. This zone enriched in rhenium and other refractory elements acts as an initiator for the formation of the topologically close packed phases. The topologically close packed phases are needle shaped.

The topologically close packed phases form at the interface between the high rhenium containing single crystal superalloy and the platinum aluminide coating. The topologically close packed phases form either after all the process steps for forming the platinum aluminide or following exposure of the platinum aluminide and high rhenium containing single crystal superalloy to high temperatures. The topologically close packed phases contain high levels of rhenium, compared to the single crystal superalloy, and are more easily formed as the rhenium content of the single crystal superalloy increases. The topologically close packed phases effect the performance of the single crystal superalloy component, because the topologically close packed phase region has lower creep strength than the single crystal superalloy. It will therefore reduce the effective load bearing cross-section of the turbine blade, or turbine vane.

Figure 3:
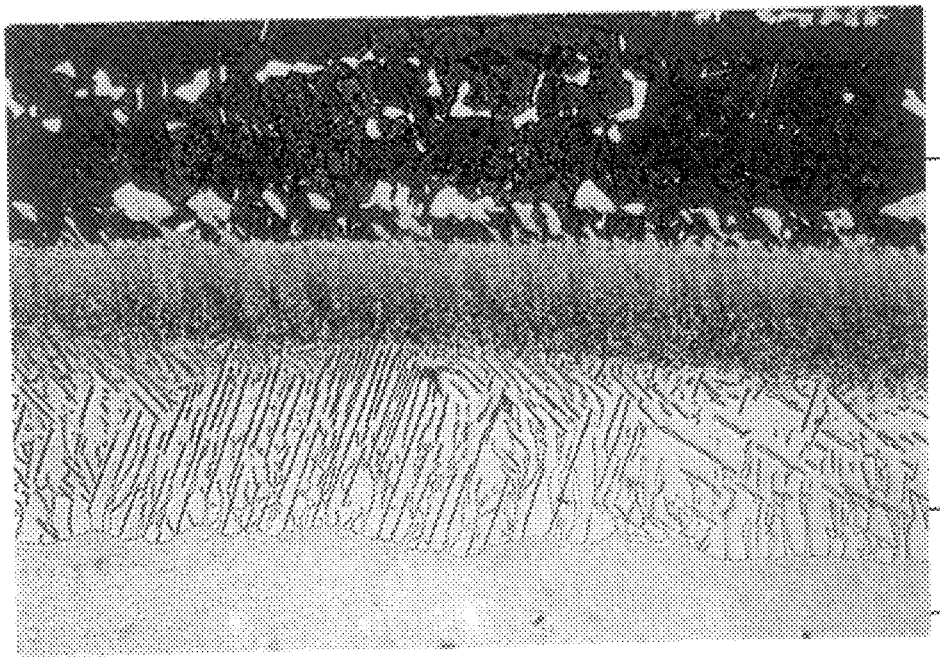
FIG. 3 is a cross-sectional view through the prior art platinum aluminide coating on a high rhenium containing single crystal superalloy after ageing at a high temperature.

A conventional platinum aluminide coating 22 on a high rhenium containing single crystal superalloy substrate 20 after ageing at high temperature is shown in FIG. 3. Additionally topologically close packed phases 24 are present at the interface between the platinum aluminide coating 22 and the high rhenium containing single crystal superalloy substrate 20.

The present invention modifies the surface of a high rhenium containing single crystal superalloy in a manner which allows the platinum layer to diffuse into the high rhenium containing single crystal superalloy, in the following heat treatment step, without the formation of the zone enriched in rhenium and other refractory elements in front of the platinum. The subsequent aluminising and heat treatment steps produce a platinum aluminide coating without topologically close packed phases at the interface between the high rhenium containing single crystal superalloy and the platinum aluminide.

EXAMPLE 1

A sample of a conventional low rhenium containing nickel based single crystal superalloy, for example CMSX4, was platinum aluminised according to the following procedure.

CMSX4 is produced by the Cannon-Muskegon Corporation of 2875 Lincoln Street, Muskegon, Mich. 49443-0506, USA. CMSX4 has a nominal composition of 6.4 wt % tungsten, 9.5 wt % cobalt, 6.5 wt % chromium, 3.0 wt % rhenium, 5.6 wt % aluminium, 6.5 wt % tantalum, 1.0 wt % titanium, 0.1 wt % hafnium, 0.6 wt % molybdenum, 0.006 wt % carbon and the balance is nickel.

A platinum layer was deposited onto the low rhenium containing nickel based single crystal superalloy by electroplating, sputtering, CVD, PVD or other suitable method to a thickness in the range 2.5 to 12.5 microns and was heat treated in a vacuum, or a protective atmosphere, for 1 to 4 hours at a temperature within the range 900° C. to 1150° C. to diffuse the platinum into the low rhenium containing nickel based single crystal superalloy. More specifically the platinum was deposited by electroplating to a thickness of 7 microns and was heat treated in a vacuum for 1 hour at 1100° C.

Then the diffused platinum plated low rhenium containing nickel based single crystal superalloy was aluminised by pack aluminising, out of pack aluminising or CVD aluminising within the temperature range 700° C. to 1150° C. More specifically the diffused platinum plated low rhenium containing nickel based single crystal superalloy was pack aluminised for 20 hours at 875° C.

Then the platinum aluminised low rhenium containing nickel based single crystal superalloy was heat treated in a vacuum, or a protective atmosphere, for 1 hour at 1100° C. and 16 hours at 870° C.

A low rhenium containing nickel based single crystal superalloy with a platinum aluminide coating as shown in FIG. 1 was produced. Samples of the low rhenium containing nickel based single crystal superalloy with a platinum aluminide coating were exposed in cyclic oxidation tests for 200 hours at 1050° C. and for 100 hours at 1100° C. and no topologically close packed phases were found beneath the platinum aluminide coating in either case.

EXAMPLE 2

Samples of a high rhenium containing nickel based single crystal superalloy, for example CMSX10, were platinum aluminised according to the following procedure. The rhenium containing nickel based single crystal superalloy is known as CMSX 10 and is produced by the Cannon-Muskegon Corporation of 2875 Lincoln Street, Muskegon, Mich. 49443-0506, U.S.A. This alloy has a nominal composition range of 3.5 to 6.5 wt % tungsten, 2.0 to 5.0 wt % cobalt, 1.8 to 3.0 wt % chromium, 5.5 to 6.5 wt % rhenium, 5.3 to 6.5 wt % aluminium, 8.0 to 10.0 wt % tantalum, 0.2 to 0.8 wt % titanium, 0.25 to 1.5 wt % molybdenum, 0 to 0.03 wt % niobium, 0.02 to 0.05 wt % hafnium, 0 to 0.04 wt % carbon and a balance of nickel.

A platinum layer was deposited onto the samples of the high rhenium containing nickel based single crystal superalloy by electroplating, sputtering, CVD, PVD or other suitable method to a thickness in the range 2.5 to 12.5 microns and was heat treated in a vacuum, or protective atmosphere, for 1 to 4 hours at a temperature within the range 900° C. to 1150° C. to diffuse the platinum into the high rhenium containing nickel based single crystal superalloy. More specifically the platinum layer was deposited by electroplating to a thickness of 7 microns and was heat treated for 1 hour at 1100° C.

Then the diffused platinum coated samples of high rhenium containing nickel based single crystal superalloy were aluminised using pack aluminising, out of pack aluminising or CVD aluminising within the temperature range 700° C. to 1150° C. More specifically the diffused platinum coated high rhenium containing nickel based single crystal superalloy samples were aluminised using out of pack aluminising for 6 hours at 1080° C.

Then the platinum aluminised samples of high rhenium containing nickel based single crystal superalloy was heat treated in a protective atmosphere for 1 hour at 1100° C. and 16 hours at 870° C.

Figure 2:
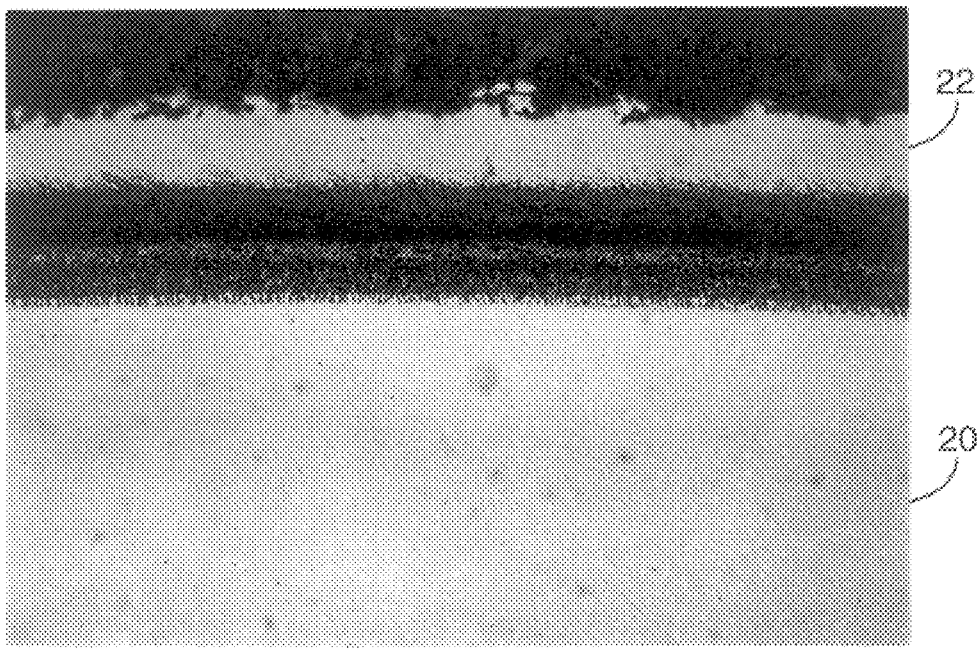
FIG. 2 is a cross-sectional view through a prior art platinum aluminide coating on a high rhenium containing single crystal superalloy.

A high rhenium containing nickel base single crystal single crystal superalloy substrate 20 with a platinum aluminide coating 22 is shown in FIG. 2.

One of the samples was examined and zones containing topologically close packed phases were found to a depth of 30 microns at the interface between the platinum aluminide and the rhenium containing nickel based single crystal superalloy.

Samples of the high rhenium containing nickel based single crystal superalloy with a platinum aluminide coating were exposed in cyclic oxidation tests for 100 hours at 1100° C., and subsequent examination revealed growth of the topologically close packed phases to form a continuous zone with a depth of 160 microns at the interface between the platinum aluminide and the rhenium containing nickel based single crystal superalloy.

A high rhenium containing nickel based single crystal superalloy substrate 20 with a platinum aluminide coating 22 after ageing at a temperature of 1100° C. is shown in FIG. 3, which has topologically close packed phases 24.

EXAMPLE 3

Samples of a high rhenium containing nickel based single crystal superalloy were platinum aluminised according to the following procedure. The high rhenium containing nickel based single crystal superalloy is known as CMSX 10 and is produced by the Cannon-Muskegon Corporation of 2875 Lincoln Street, Muskegon, Mich. 49443-0506, U.S.A. This alloy has a nominal composition as discussed above.

Samples of the high rhenium containing nickel based single crystal superalloy had there surfaces modified by formation of a chromium enriched surface layer using electroplating, sputtering, CVD, PVD or other suitable methods plus a diffusion heat treatment in vacuum, or protective atmosphere. More specifically the chromium enrichment was accomplished by out of pack chromising for 3 hours at a temperature of 1100° C. to form a chromium enriched surface layer 15 microns in depth.

A platinum layer was deposited onto the chromium enriched high rhenium containing nickel based single crystal superalloy by electroplating, sputtering, CVD, PVD or other suitable method to a thickness in the range 2.5 to 12.5 microns and was heat treated in a vacuum, or protective atmosphere, for 1 to 4 hours at a temperature within the range 900° C. to 1150° C. to diffuse the platinum into the high rhenium containing nickel based single crystal superalloy. More specifically the platinum layer was deposited by electroplating to a thickness of 7 microns and was heat treated for 1 hour at 1100° C.

Then the chromised, diffused, platinum coated high rhenium containing nickel based single crystal superalloy was aluminised by pack aluminising, out of pack aluminising or CVD aluminising within the temperature range 700° C. to 1150° C. More specifically the chromised, diffused, platinum coated high rhenium containing nickel based single crystal superalloy samples were aluminised using out of pack aluminising for 6 hours at 1080° C.

The platinum aluminised chromised high rhenium containing nickel based single crystal superalloy was heat treated for 1 hour at 1100° C. plus 16 hours at 870° C.

One of the samples was examined and no zones containing topologically close packed phases were found at the interface between the platinum aluminide and the high rhenium containing nickel based single crystal superalloy.

Some of the samples were exposed to an oxidising environment for 100 hours at 1100° C., and subsequent examination revealed no topologically close packed phases at the interface between the platinum aluminide and the high rhenium containing nickel based single crystal superalloy.

Figure 4:
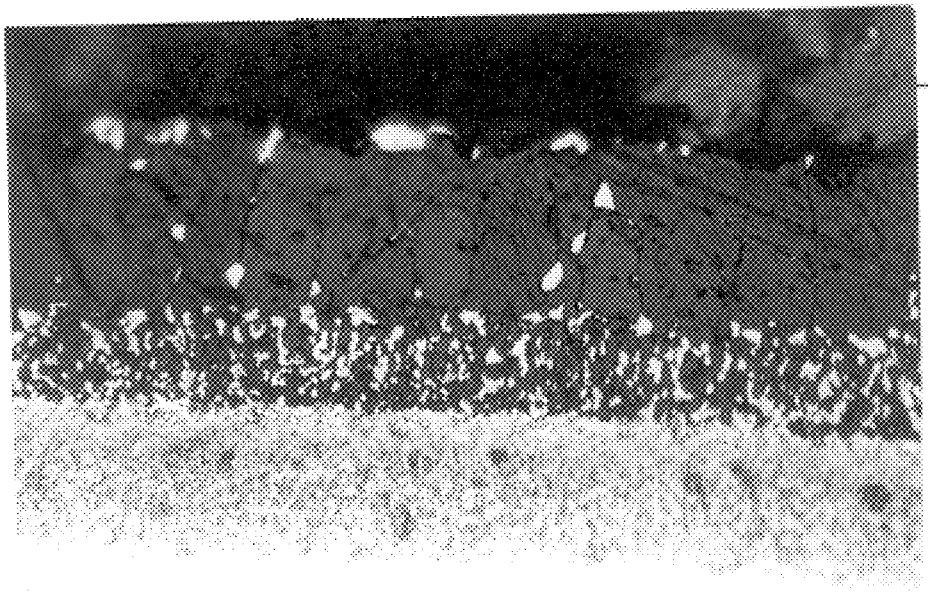
FIG. 4 is cross-sectional view through a chromium modified platinum aluminide coating according to the present invention on a high rhenium containing single crystal superalloy.

A high rhenium containing nickel base single crystal single crystal superalloy substrate 30 with a chromium modified platinum aluminide coating 32 is shown in FIG. 4.

EXAMPLE 4

Samples of a high rhenium containing nickel based single crystal superalloy was platinum aluminised according to the following procedure. The high rhenium containing nickel based single crystal superalloy is known as CMSX 10 and is produced by the Cannon-Muskegon Corporation of 2875 Lincoln Street, Muskegon, Mich. 49443-0506, U.S.A. This alloy has a nominal composition as discussed above.

Samples of the high rhenium containing nickel based single crystal superalloy had there surfaces modified by formation of a cobalt enriched surface layer using electroplating, sputtering, CVD, PVD or other suitable methods plus a diffusion heat treatment in vacuum, or protective atmosphere. A cobalt layer was deposited onto the high rhenium containing single crystal superalloy by electroplating, sputtering, CVD, PVD or other suitable method to a thickness of 2.5 to 12.5 microns and was heat treated in a vacuum, or protective atmosphere, for 1 to 4 hours at a temperature within the range 900° C. to 1150° C.

More specifically the cobalt layer was deposited onto the high rhenium containing nickel based single crystal superalloy by electroplating to a thickness of 7 microns and was heat treated in a vacuum for 1 hour at 1100° C.

A platinum layer was deposited onto the cobalt enriched high rhenium containing nickel based single crystal superalloy by electroplating, sputtering, CVD, PVD or other suitable method to a thickness in the range 2.5 to 12.5 microns and was heat treated in a vacuum, or protective atmosphere, for 1 to 4 hours at a temperature within the range 900° C. to 1150° C. to diffuse the platinum into the high rhenium containing nickel based single crystal superalloy. More specifically the platinum layer was deposited by electroplating to a thickness of 7 microns and was heat treated for 1 hour at 1100° C.

Then the cobalt enriched, diffused, platinum coated high rhenium containing nickel based single crystal superalloy was aluminised by pack aluminising, out of pack aluminising or CVD aluminising within the temperature range 700° C. to 1150° C. More specifically the cobalt enriched, diffused, platinum coated high rhenium containing nickel based single crystal superalloy samples were aluminised using out of pack aluminising for 6 hours at 1080° C.

The platinum aluminised cobalt enriched high rhenium containing nickel based single crystal superalloy was heat treated for 1 hour at 1100° C. plus 16 hours at 870° C. One of the samples was examined and no zones containing topologically close packed phases were found at the interface between the platinum aluminide coating and the high rhenium containing nickel based single crystal superalloy.

Figure 5:
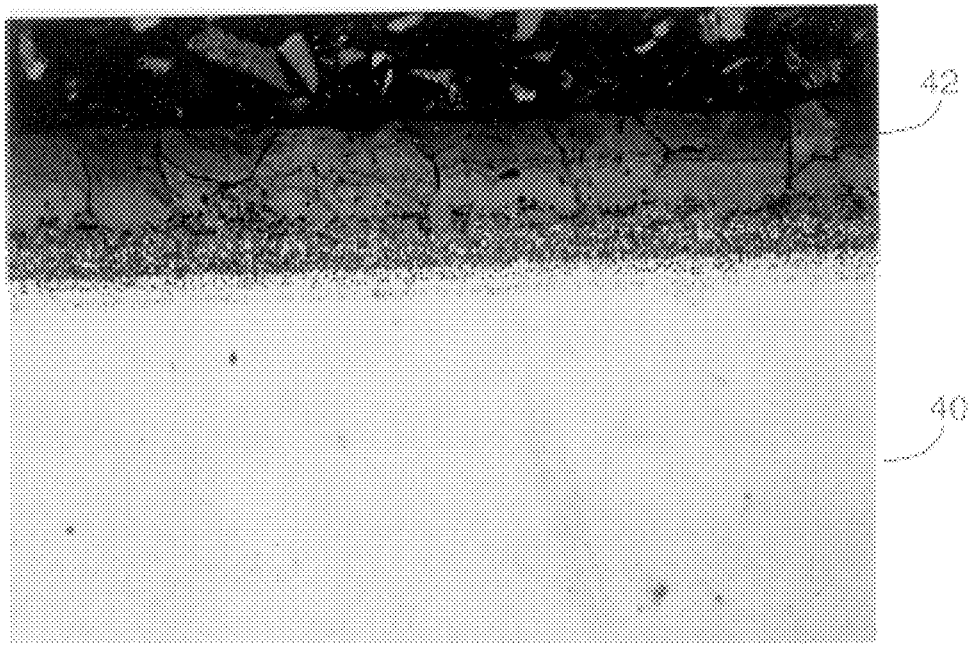
FIG. 5 is a cross-sectional view through a cobalt modified platinum coating according to the present invention on a high rhenium containing single crystal superalloy.

A high rhenium containing nickel base single crystal single crystal superalloy substrate 40 with a cobalt modified platinum aluminide coating 42 is shown in FIG. 5.

Some of the samples were exposed to an oxidising environment for 100 hours at 1100° C., and subsequent examination revealed no topologically close packed phases at the interface between the platinum aluminide and the high rhenium containing nickel based single crystal superalloy.

Figure 6:
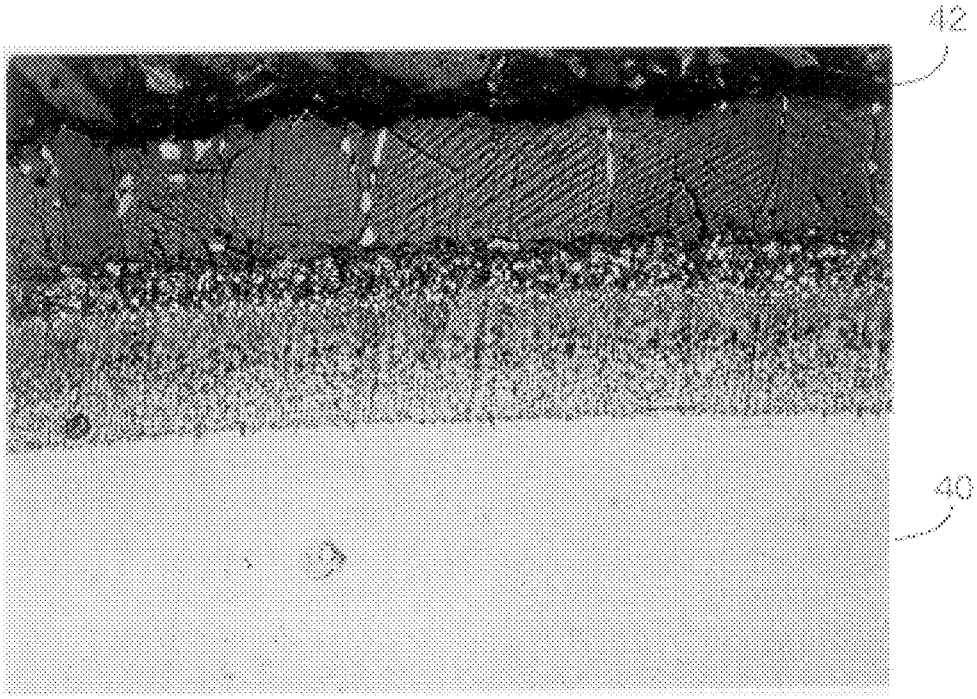
FIG. 6 is a cross-sectional view through a cobalt modified platinum coating according to the present invention on a high rhenium containing single crystal superalloy after against at a high temperature.

A high rhenium containing nickel base single crystal single crystal superalloy substrate 40 with a cobalt modified platinum aluminide coating 42 after exposure to an oxidising environment is shown in FIG. 6.

It is also to possible to prepare the surface of the high rhenium containing single crystal superalloy by reducing the level of rhenium at the surface of the high rhenium containing nickel based superalloy before the platinum is deposited onto the rhenium containing single crystal superalloy. The rhenium may be removed from the surface of the high rhenium containing single crystal superalloy by gases which selectively react with the rhenium in the superalloy at high temperatures to remove the rhenium.

Although the present invention has referred to high rhenium containing nickel based single crystal superalloys the invention is also applicable to any high rhenium containing nickel based superalloys.

Although the invention has referred to platinum aluminide coatings the invention is also applicable to other platinum-group metal aluminide coatings, for example palladium aluminide, rhodium aluminide or combinations of these platinum-group metal aluminide coatings.

The invention is also applicable to the production of platinum-group metal aluminide bond coatings on high rhenium containing nickel based superalloys for ceramic thermal barrier coatings, for example plasma sprayed, or PVD, ceramic thermal barrier coatings.

Although the invention has referred to platinum aluminide coatings the invention is also applicable to platinum aluminide-silicide coatings, aluminide-silicide coatings and simple aluminide coatings or other suitable aluminide coatings.

In the case of the platinum aluminide-silicide coatings the surface of the high rhenium containing single crystal superalloy is modified by applying the suitable metal, for example chromium or cobalt, and heat treating or by reducing the rhenium content before application of the platinum aluminide-silicide coating.

In the case of the aluminide-silicide coatings and aluminide coatings the surface of the high rhenium containing superalloy is modified by applying the suitable metal, for example chromium or cobalt, and heat treating or by reducing the rhenium content before application of the aluminide coating or aluminide-silicide coating.

The more detailed description of these coatings is provided in the present application and further details are available with reference to the aforementioned patents and published patent applications.

I claim:

1. A method of aluminising a high rhenium containing superalloy comprising the steps of:

(a) modifying the surface of the high rhenium containing superalloy by applying a layer of chromium or cobalt to the surface of the high rhenium containing superalloy and heat treating to diffuse the chromium or cobalt into the high rhenium containing superalloy to reduce the rhenium content of the surface of the high rhenium containing superalloy, and (b) aluminising the high rhenium containing superalloy to form an aluminide coating, wherein the high rhenium containing superalloy comprises at least 3.5 wt % rhenium;

wherein any subsequent formation of topologically close packed phases is substantially prevented by said modifying of the surface of the high rhenium containing superalloy.

2. A method as claimed in claim 1 wherein step (a) comprises applying the chromium or cobalt to the high rhenium containing superalloy by electroplating, sputtering, pack diffusion, out of pack diffusion, chemical vapor deposition or physical vapor deposition.

3. A method as claimed in claim 1 wherein step (a) comprises heat treating at a temperature in the range of 900° C. to 1150° C. for 1 to 4 hours.

4. A method as claimed in claim 1 wherein step (a) comprises applying a layer of cobalt to a thickness of 2.5 to 12.5 microns to the high rhenium containing superalloy by electroplating and heat treating at a temperature in the range of 900° C. to 1150° C. for 1 to 4 hours.

5. A method as claimed in claim 1 wherein step (a) comprises chromising the surface of the high rhenium containing superalloy at a temperature of 1100° C. for 3 hours.

6. A method as claimed in claim 1 wherein step (b) comprises aluminising at a temperature in the range 700° C. to 1150° C.

7. A method as claimed in claim 1 wherein step (b) comprises pack aluminising, out of pack gas phase aluminising, chemical vapour deposition or slurry aluminising.

8. A method as claimed in claim 1 wherein the high rhenium containing superalloy comprises 4 to 8 wt % rhenium.

9. A method as claimed in claim 8 wherein the high rhenium containing superalloy is nickel based.

10. A method as claimed in claim 9 wherein the high rhenium containing superalloy comprises 3.5 to 6.5 wt % tungsten, 2.0 to 5.0 wt % cobalt, 1.8 to 3.0 wt % chromium, 5.5 to 6.5 wt % rhenium, 5.3 to 6.5 wt % aluminium, 8.0 to 10.0 wt % tantalum, 0.2 to 0.8 wt % titanium, 0.25 to 1.5 wt % molybdenum, 0 to 10 0.03 wt % niobium, 0.02 to 0.05 wt % hafnium, 0 to 0.04 wt % carbon and a balance of nickel plus incidental impurities.

11. A method as claimed in claim 1 wherein step (b) comprises diffusing silicon into the high rhenium containing superalloy during the aluminising step to form an aluminide-silicide coating.

12. A method as claimed in claim 11 comprising depositing a slurry containing elemental aluminium and silicon powders and heat treating to diffuse the aluminium and silicon into the high rhenium containing superalloy.

13. A method as claimed in claim 12 comprising repeatedly depositing a slurry containing elemental aluminium and silicon powders and heat treating to diffuse the aluminium and silicon into the high rhenium containing superalloy.

14. A method as claimed in claim 1, wherein the modifying of the surface acts to at least reduce the formation of topologically close packed phases at a subsequently formed interface between the high rhenium containing superalloy and the aluminide coating.

15. A method of platinum aluminising a high rhenium containing superalloy comprising the steps of:

(a) modifying the surface of the high rhenium containing superalloy by applying a layer of chromium or cobalt to the surface of the high rhenium containing superalloy and heat treating to diffuse the chromium or cobalt into the high rhenium containing superalloy to reduce the rhenium content of the surface of the high rhenium containing superalloy, (b) applying a layer of platinum-group metal to the modified surface of the high rhenium containing superalloy, (c) heat treating the platinum-group metal coated high rhenium containing superalloy to diffuse the platinum-group metal into the high rhenium containing superalloy, (d) aluminising the high rhenium containing superalloy to form an aluminide coating, and (e) heat treating the aluminised, platinum-group metal coated high rhenium containing superalloy to form a platinum-group metal aluminide coating, wherein the high rhenium containing superalloy comprises at least 3.5 wt % rhenium; and wherein any subsequent formation of topologically close packed phases is substantially prevented by said modifying of the surface of the high rhenium containing superalloy.

16. A method as claimed in claim 15 wherein step (b) comprises applying a layer of platinum-group metal by electroplating, sputtering, chemical vapor deposition or physical vapor deposition to a thickness between 2.5 microns and 12.5 microns.

17. A method as claimed in claim 15 wherein step (b) comprises applying a layer of platinum.

18. A method as claimed in claim 15 wherein step (c) comprises heat treating at a temperature in the range of 900° C. to 1150° C. for 1 to 4 hours.

19. A method as claimed in claim 15 comprising the additional step (f) of depositing a ceramic thermal barrier coating on the platinum-group metal aluminide coating.

20. A method as claimed in claim 19 wherein the depositing of the ceramic thermal barrier coating is by plasma spraying or physical vapor deposition.

21. A method as claimed in claim 15 comprising diffusing silicon into the high rhenium containing superalloy during step (c) or during step (d) to form an aluminide-silicide coating.

22. A method as claimed in claim 21 comprising depositing a slurry containing elemental aluminium and silicon powders and heat treating to diffuse the aluminium and silicon into the high rhenium containing superalloy.

23. A method as claimed in claim 22 comprising repeatedly depositing a slurry containing elemental aluminium and silicon powders and heat treating to diffuse the aluminium and silicon into the high rhenium containing superalloy.

24. A method of aluminising a high rhenium containing superalloy comprising the steps of:

(a) modifying the surface of the high rhenium containing superalloy by reducing the rhenium content of the surface of the high rhenium containing by reacting the rhenium in the superalloy at high temperature with gases which selectively react with the rhenium, and (b) aluminising the high rhenium containing superalloy to form an aluminide coating, wherein the high rhenium containing superalloy comprises at least 3.5 wt % rhenium.

* * * * *

UNITED STATES PATENT AND TRADEMARK OFFICE

CERTIFICATE OF CORRECTION

PATENT NO. : 6,080,246
DATED : June 27, 2000
INVENTOR(S) : Rodney G. Wing

It is certified that error appears in the above-identified patent and that said Letters Patent is hereby corrected as shown below:

Title page,

Item [73] Assignee, add the second joint assignee -- Chromalloy United Kingdom Limited, Nottingham, United Kingdom --.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*